US010918225B2

(12) United States Patent
Olesen

(10) Patent No.: US 10,918,225 B2
(45) Date of Patent: Feb. 16, 2021

(54) REFRIGERATED MERCHANDISING STORAGE UNIT WITH DISPLACEABLE LIDS

(71) Applicant: Rehau-Behr A/S, Hadsten (DK)

(72) Inventor: Søren Olesen, Hadsten (DK)

(73) Assignee: Rehau-Behr A/S, Hadsten (DK)

( * ) Notice: Subject to any disclaimer, the term of this patent is extended or adjusted under 35 U.S.C. 154(b) by 0 days.

(21) Appl. No.: 16/340,580

(22) PCT Filed: Sep. 19, 2017

(86) PCT No.: PCT/EP2017/073591
§ 371 (c)(1),
(2) Date: Apr. 9, 2019

(87) PCT Pub. No.: WO2018/069004
PCT Pub. Date: Apr. 19, 2018

(65) Prior Publication Data

US 2019/0290021 A1 Sep. 26, 2019

(30) Foreign Application Priority Data

Oct. 11, 2016 (EP) ..... 16193352

(51) Int. Cl.
*A47F 3/04* (2006.01)
*F25D 23/02* (2006.01)

(52) U.S. Cl.
CPC ..... *A47F 3/0478* (2013.01); *A47F 3/043* (2013.01); *F25D 23/021* (2013.01);
(Continued)

(58) Field of Classification Search
CPC ..... A47F 3/0434; A47F 3/0413; A47F 3/043; A47F 3/0478; F25D 23/087;
(Continued)

(56) References Cited

U.S. PATENT DOCUMENTS 2,192,519 A 3/1940 King
3,208,809 A * 9/1965 Quimper ..... F25D 23/026 312/295

(Continued)

FOREIGN PATENT DOCUMENTS

EP 2 645 025 A2 10/2016
JP H10 113258 A 5/1998

(Continued)

OTHER PUBLICATIONS

International Search Report completed Nov. 20, 2017 for International Application No. PCT/EP2017/073591.

*Primary Examiner* — Hiwot E Tefera
(74) *Attorney, Agent, or Firm* — Brinks Gilson & Lione

(57) ABSTRACT

A refrigerated merchandising storage unit for display and sale of foodstuff or the like is disclosed including a storage compartment having an essentially rectangular top opening, the storage unit further includes a cover including a plurality of lids for being arranged displaceably for opening the storage unit and a rail system with two or more mounted rails arranged between two opposite sides of the opening. Each rail includes a number of elongated and generally U-shaped tracks wherein each of the lids are arranged to be mounted between a first and a second rail adjacent to one another. The first rail includes a first track and the second rail includes a second track, and the rails are arranged such that the lid can be mounted by displacing an edge of the lid inside the first track until the opposite edge of the lid can be inserted inside the second track. The storage unit further includes a retainer arrangement provided near the first track or the second track and the lid for retaining the lid in that track. The retainer arrangement includes a latch fixed to the lid and a protrusion fixed to that track, the latch and the protrusion being arranged such that when lateral extraction forces are applied to the lid in a direction away from the
(Continued)

track, the latch and the protrusion are forced into abutment producing a holding force so that a separation of the lid and the track is prevented.

16 Claims, 7 Drawing Sheets

(52) U.S. Cl.
CPC ..... *F25D 23/026* (2013.01); *A47F 3/0434* (2013.01); *F25D 2323/02* (2013.01)

(58) Field of Classification Search
CPC .. F25D 23/026; F25D 23/021; F25D 2400/10; F25D 11/00; F25D 2323/02
USPC ..... 312/405, 139.2, 138.1, 295, 296, 323, 312/328; 220/592.02; 62/246
See application file for complete search history.

(56) References Cited

U.S. PATENT DOCUMENTS 6,141,984 A * 11/2000 Perzon ..... A47F 3/043 62/275
6,247,773 B1 * 6/2001 Harigai ..... A47F 3/0434 312/139.2
2001/0026115 A1 * 10/2001 Hakemann ..... A47F 3/043 312/138.1
2002/0190619 A1 12/2002 Brauer
2009/0224544 A1 9/2009 Bartlett
2013/0008090 A1 * 1/2013 Lanzl ..... F25D 23/021 49/413
2015/0115782 A1 * 4/2015 Resch ..... F25D 11/00 312/116

FOREIGN PATENT DOCUMENTS

JP 2012 196313 A 10/2012
WO WO 97/19621 A1 6/1997

* cited by examiner

REFRIGERATED MERCHANDISING STORAGE UNIT WITH DISPLACEABLE LIDS

This application claims the benefit under 35 U.S.C. § 371 of International Application No. PCT/EP2017/073591, filed Sep. 19, 2017, which claims the priority of European Patent Application No. EP 16193352.8, filed Oct. 11, 2016; which are incorporated by reference herein in their entirety.

The present invention relates to a refrigerated merchandising storage unit, such as a refrigerator or a freezer with a rectangular top opening with slidably displaceable lids which can be moved, sideways or back and forth, such that an opening can be created into the cooled compartment.

BACKGROUND

Refrigerated display and storage unit typically used in supermarkets and the like for displaying food, typically have a top opening covered with transparent lids such that the grocery of choice can easily be located by the customers. The lids may be displaced in different ways such that the groceries may be accessible for the customer. It is known to mount lids so that the compartment is accessible by displacing the lid like a door, i.e. one side of the lid is for example attached to the storage unit using hinges. Other methods include the use of slidable lids. These can be either displaced sideways or forwardly, sliding underneath or on top of a neighbouring lid, or underneath a stationary cover section of the compartment. Generally the transparent lids are fixably mounted in a frame which in turn is slidably mounted in tracks. Examples hereof are known from US 2002/0190619 and US 2009/0224544. The lids can also be directly mounted in the tracks and slidably rest on the surface of the track. In order to prevent dislocating from the track, the rails can be pushed towards each other, enclosing the lid, so that the rails or a part thereof would need to be moved upon replacement of the lids. An example hereof is known from WO 97/19621.

It is an object of the invention is to provide a refrigerated storage unit having a lid which can be easily installed and replaced by a simple manoeuvre which requires a minimum amount of labour. It is a second object of the invention to provide a refrigerated storage unit having an essentially frameless lid which comprising a minimum amount of elements and providing maximum visibility of the content within the compartment.

But by failing to properly retain the lids in the tracks when mounted there exist a risk of separating the lids from the tracks when in use. The lids and the track can disconnect and the lid may fall into the storage unit, which is very inconvenient. Therefore a further object of the invention is to provide a lid which is slidably retained in the tracks such that the risk of separation is reduced or eliminated.

BRIEF DESCRIPTION OF THE INVENTION

The present invention relates to a refrigerated merchandising storage unit for display and sale of foodstuff or the like comprising a storage compartment having an essentially rectangular top opening, wherein the storage unit further comprises a cover including a plurality of lids for being arranged displaceably for opening the storage unit so that access can be provided to the compartment. The cover is provided with a rail system with two or more mounted rails arranged between two opposite sides of the opening, wherein each rail comprises a number of elongated and generally U-shaped tracks for receiving an edge of said lid, wherein each of the lids are arranged to be mounted between a first and a second rail adjacent to one another, wherein the first rail comprises a first track and the second rail comprises a second track, wherein the rails are arranged such that the lid can be mounted by displacing an edge of the lid inside the first track until the opposite edge of the lid can by swung in to position substantially in the plane of the lid and adjacent to the second track of the adjacent second rail, whereby said opposite edge of the lid can be inserted inside the second track and the lid thereby can be displaceably mounted between the two adjacent rails. The storage unit further comprises a retainer arrangement provided near said first track or said second track and said lid for retaining the lid in that track, wherein the retainer arrangement comprises a latch fixed to the lid and a protrusion fixed to that track, the latch and the protrusion being arranged such that when lateral extraction forces are applied to the lid in a direction away from the track, the latch and the protrusion are forced into abutment producing a holding force so that a separation of the lid and the track is prevented. Either the protrusion or the latch is made of a resilient flexible material such that the edge of the lid can be inserted into the track, by either bending the latch towards the second surface of the lid or the protrusion towards the side of the track on which it protrudes from.

Advantageously, this provides for the latches and protrusions to pass each other when the lids are mounted in the corresponding tracks. Additionally or alternatively the protrusion may also be deflected or bend sideways, inwardly or outwardly in order to allow the lid to be inserted in the track. In one or more embodiments of the present invention, the latch as well as the protrusion may be resiliently displaceable in order for allowing the edge of the lid to enter into the track.

By the present invention it is achieved that the lids can be easily mounted in the tracks after the rails are mounted on the storage unit. Each rail may comprise two or three elongated and generally U-shaped tracks, wherein each track may be arranged to receive an edge of a lid. The retainer arrangement ensures that the lids do not by accident slip out of the shallow track and enables a practical use of the above-mentioned combination of a deep track and a shallow track for mounting of the lids. The lids may be displaced along a direction orientated in parallel with the plane of the lids. The compartment may be utilized for storing elements such as food stuff and groceries and the lids may be displaced to allow customers to access these elements.

In one or more embodiments, the first track is a deep track and the second track is a shallow track, wherein the deep track is deeper than the shallow track, and wherein said retainer arrangement is provided near said second, shallow track.

In a preferred embodiment of the invention, the deep track(s) is/are provided with corresponding protrusion(s) fixed to the deep track(s) and the lid(s) further comprises a latch/latches arranged to cooperate with the protrusion(s) of the deep track(s) in a retainer arrangement. By providing a retainer arrangement at each opposing side of the lids, the lids will be able to withstand variations in the distance between the adjacent rails comprising the tracks without disengaging with one of the tracks and risk falling into the storage compartment. The distance between adjacent rails may in particular be enlarged when the rails are mounted parallel to the longitudinal direction of the storage unit, i.e. with a rail along one side of the of the top opening and another near or at the middle of the top opening, because the longitudinal sides of the storage unit typically are able to move back and forth as e.g. a customer leans on the side of the storage unit. The retainer arrangements at both opposite sides of the lids enables the lids to delimit the magnitude of the variation in distance between the adjacent rails and thus prevents the lids from being accidentally dismounted from the rails.

The protrusions of the retainer arrangements extend in a preferred embodiment generally perpendicular to and inwardly from a side of the track.

The latches are preferably attached to a first surface of the lid and extend around the edge of the lid towards a second surface of the lid where from it projects away from the lid towards a position above the second surface of the lid. In this manner, the latches can be firmly secured to the lids at the edges thereof.

Preferably, the latches are fixably attached to the lids by using adhesive. In certain embodiments of the present invention, the latches as well as the protrusions are arranged flexible for both to bend or deflect while passing each other during mounting of the lids.

The lids are preferably slidably supported on at least a part of inner surfaces of the tracks so that no parts external to the tracks are necessary for the lids to be supported in place.

The rails are preferably formed as profiles comprising a plurality of tracks, such as in particular two or three tracks, which are arranged above one another in a vertical row.

Furthermore, one or more of the rails may be formed as profiles comprising two vertical rows of tracks arranged back to back and fixed to one another.

Said vertical row of tracks comprised in a rail may in a preferred embodiment comprise either deep or shallow tracks only. Additionally, the tracks comprised in the adjacent rails for mounting of a lid may be deep tracks only.

Alternatively, said vertical row of tracks in a rail may comprise both deep tracks and shallow tracks.

The depth of the deep tracks is preferably in the range of 25-50 mm, preferably in the range of 30-40 mm.

The depth of the shallow tracks is preferably in the range of 5-25 mm, preferably in the range of 10-20 mm.

According to a particular embodiment of the present invention, each lid is displaceably mounted in separate tracks within the vertical row of tracks, i.e. the lids of the cover do not share tracks.

In one or more embodiments, the two or more rails of the cover of the storage unit may extend between the two long sides of the compartment, from a first long side to a second long side, and wherein the compartment is opened and closed by pushing the lids in a direction perpendicular to the long sides of the compartment. In a particular embodiment hereof, the cover comprises three longitudinal rows of lids covering the top opening, of which one longitudinal row comprises a stationary cover plate which covers generally ⅓ of the width of the top opening and extends between the two short sides of the compartment. The cover plate is preferably transparent.

According to another embodiment, the two or more rails extend between the two short sides of the compartment, from a first short side to a second short side and the compartment is opened and closed by sliding the lids sideways in a direction parallel with the long sides of the compartment. The two or more rails near the long sides of the compartment comprise preferably shallow tracks so that these rails may be designed to be slim and allow for the widest visual and manual access to the storage compartment for the costumers. The cover according to this embodiment comprises preferably two rows of displaceable lids, wherein each row is adjacent to a long side of the compartment.

The lids are preferably transparent. The cover may be formed in a plane shape and preferably substantially orientated in the vertical plane, in an alternative embodiment, the cover is formed with a curved shape.

Correspondingly, the present invention also relates to a refrigerated merchandising storage unit comprising a cover having a plurality of mounted displaceable lids, a rail system comprising a plurality of generally U-shaped tracks, and retainer arrangements provided near the tracks, wherein each retainer arrangement comprises a latch made of resilient flexible material, attached to the displaceable lid and a protrusion attached to the side of the track, wherein the latch and the protrusion are being arranged such that when lateral extraction forces are applied to the lid in a direction away from the shallow track, the latch and the protrusion are forced into abutment producing a holding force so that a separation of the lid and the shallow track is prevented.

Furthermore, the present invention relates to a method for mounting a displaceable lid between two adjacent rails in a refrigerated merchandising storage unit, wherein the first rail comprises a deep track and the second rail comprises a shallow track and the method comprises the steps of:

displacing an edge of the lid inside the deep track, swinging the opposite edge of the lid in to a position adjacent to the shallow track of the adjacent second rail, and inserting said opposite edge of the lid inside the shallow track such that the lid is displacably mounted between the two adjacent rails.

According to the method, the lid may furthermore be displaceably retained in the two adjacent rails by using a retainer arrangement, comprising a latch attached to the lid and a protrusion attached to the track, wherein either the latch or the protrusion is flexible, and wherein the method for mounting the displaceable lid further comprises the steps of:

forcing the flexible latch or protrusion to bend such that the size of the opening of the track is increased, passing the edge of the lid through the opening of the track such that the edge of the lid is positioned inside the track, and releasing the force on the flexible latch or protrusion, such that the lid is displaceably retained in the track.

The refrigerating merchandising storage unit of the method may be the one disclosed above.

BRIEF DESCRIPTION OF THE DRAWING

Aspects of the present invention will be described in the following with reference to the enclosed drawing that shows embodiments of the present invention. The figures of the drawing are as follows:

FIG. 2*b* is a detailed perspective view of a lid mounted in a shallow track, as shown in

FIG. 1,

DETAILED DESCRIPTION OF EMBODIMENTS

Figure 1:
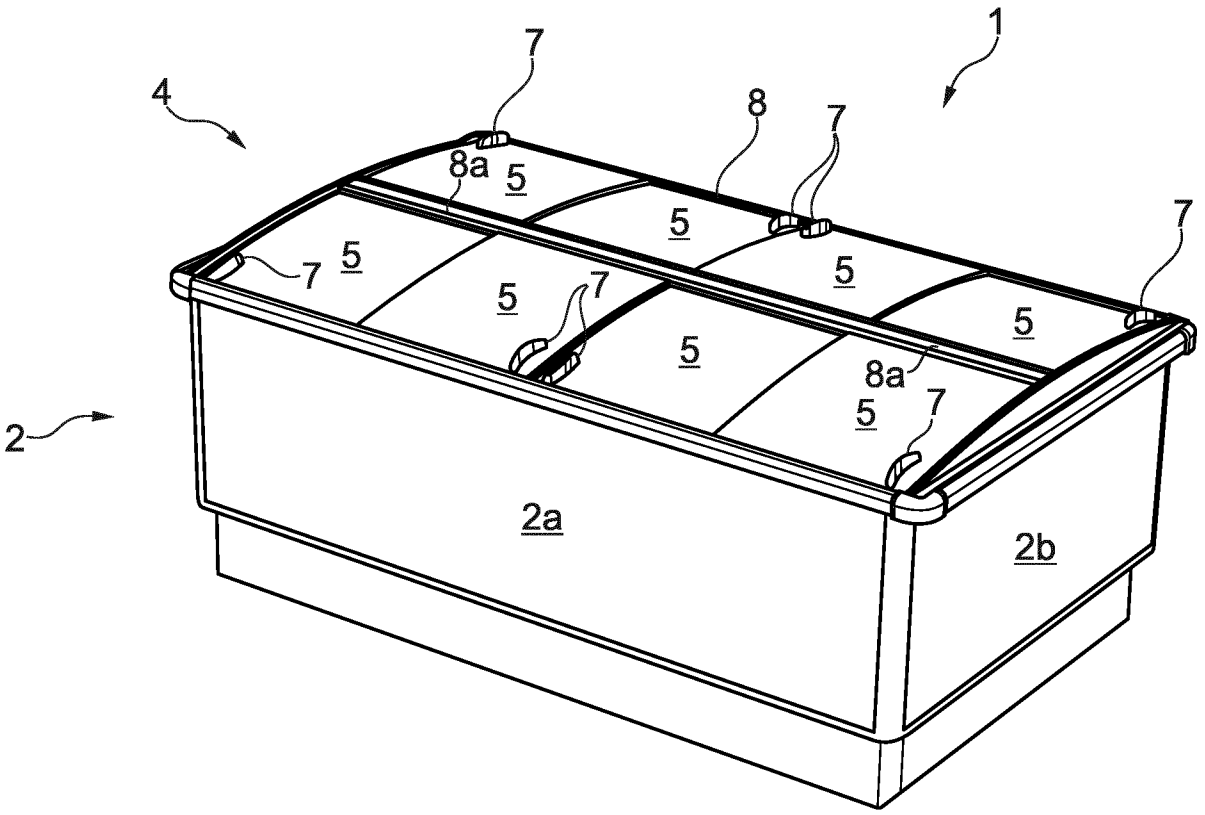
FIG. 1 is a perspective view of a refrigerated merchandising storage unit having a cover with lids arranged in a slide configuration.
Figure 5:
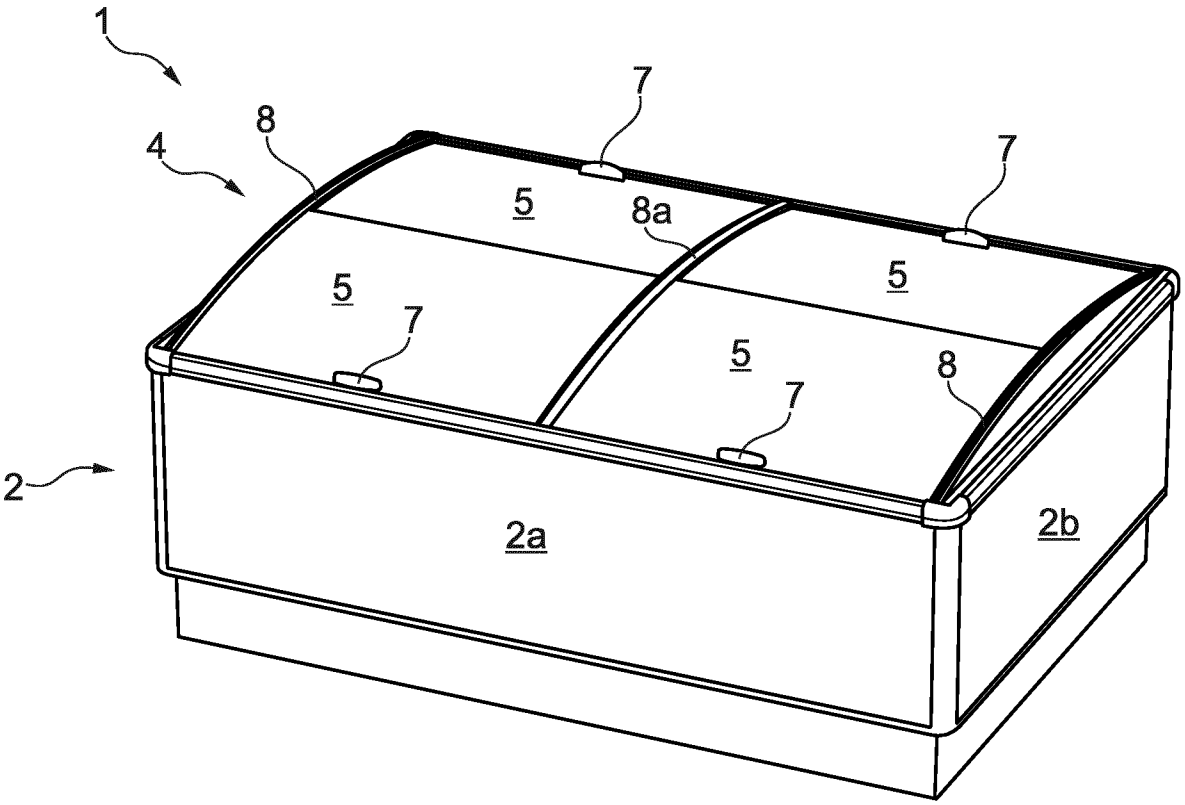
FIG. 5 is a perspective view of a refrigerated merchandising storage unit having a cover with lids arranged in a push configuration.

FIGS. 1 and 5 respectively show two examples of a refrigerated merchandising storage unit 1 in perspective having a storage compartment 2, which is can be used to store foodstuff or the like. The compartment 2 is in both examples shaped as a box, preferably a rectangular box having a bottom, two parallel long sides 2*a* and two parallel short sides 2*b*, providing an essentially rectangular, vertical top opening 3.

In FIG. 1 the top opening 3 is arranged with the cover 4 comprising two rails 8 at edges of the compartment 2 along the long sides 2*a* of the compartment 2 and a centred rail 8*a* arranged in between extending from one short side 2*b* of the compartment 2 to an opposite short side 2*b* of the compartment 2 such that the top opening 3 of the compartment 2 is divided into two generally equal sized longitudinal openings. The top opening 3 is covered by eight transparent lids 5 each mounted in adjacent rails 8, 8*a*. Two opposite and essentially parallel edges 5*a* of each lid 5 are slidably mounted in two adjacent tracks 9*a*, 9*b* of two adjacent rails 8, 8*a* such that they may be slided and displaced in a direction parallel to the long sides 2*a* of the compartment 2 by the customers in order to provide access to the storage compartment 2. The lids 5 can be arranged in an open or closed position or in a position therein between and handles 7 are attached to the lids 5 allowing for easy displacement of the lids 5 along the rails 8, 8*a*. Four lids 5 are covering each longitudinal opening and they are mounted in a symmetric configuration on each side of the centred rail 8*a*. On each side of the centred rail 8*a* two lids 5 are mounted in the top track 9 and the remaining two lids 5 are mounted in the bottom track 9 in an alternating configuration. In the present embodiments the lids 5 and the rails 8, 8*a* are curved providing for extra space enclosed by the cover 4 and the compartment 2 as shown in FIG. 1-5.

Figure 2:
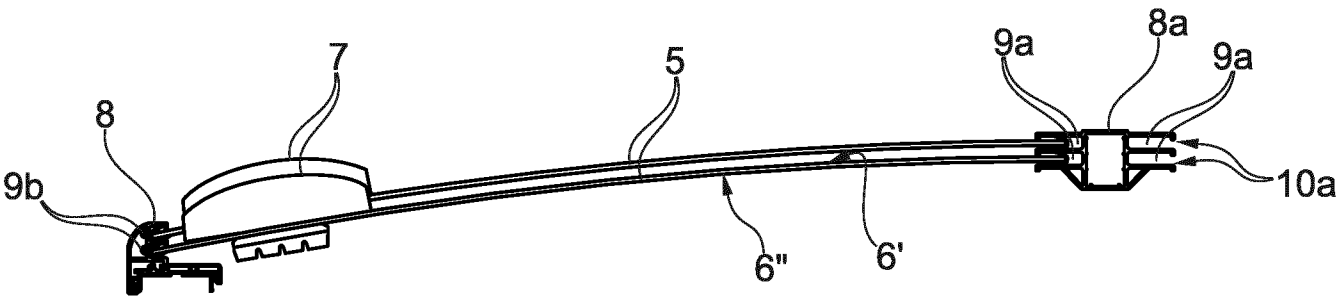
FIG. 2 shows a cross-sectional view of two lids mounted in two adjacent rails in a refrigerated merchandising storage unit as shown in FIG. 1.

FIG. 2 shows a cross-sectional view of the refrigerated merchandising storage unit 1 in FIG. 1. The rails 8 near the long sides 2*a* of the compartment 2 are E-shaped profiles, each providing two tracks 9*b*, while the centred rail 8*a* arranged in the centre of the top opening 3 and between the long sides 2*a* of the compartment 2 is a profile comprises a middle section, with two E-shaped profiles arranged on each side of the middle section, such that lids 5 can be mounted on each side of the centred rail 8*a*, this is shown in FIG. 2. FIG. 2 also shows how the rails 8 near the long sides 2*a* of the compartment 2 comprises shallow tracks 9*b* such that the rail 8 allows for larger visibility through the lids 5 near the long sides 2*a* of the storage unit 1 i.e. near the position of the customer using the storage unit 1. Correspondingly, the centred rail 8*a* near the middle of the top opening 3 comprises deep tracks 9*a*. Neighbouring lids 5 are slidably mounted in separate tracks 9*a*, 9*b*, such that the lids 5 can be displaced independently in a direction parallel to the long sides 2*a* of the compartment 2.

Figure 2A:
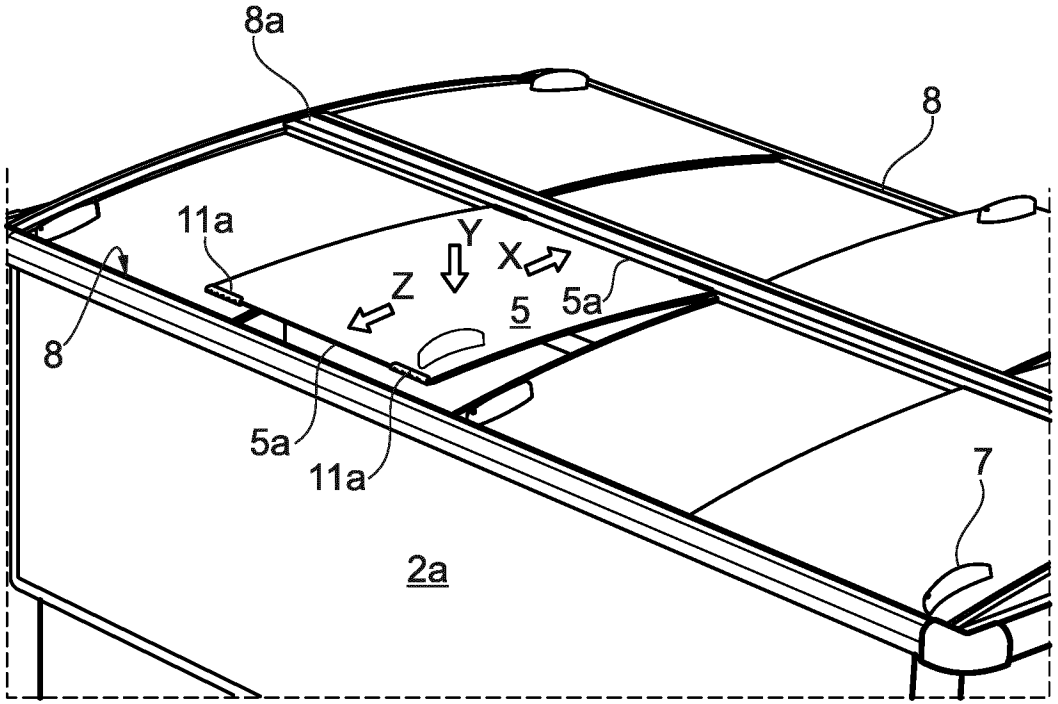
FIG. 2*a* is a perspective view of a refrigerated merchandising storage unit indicating the method of mounting a lid in adjacent rails as shown in FIG. 1.
Figure 2B:
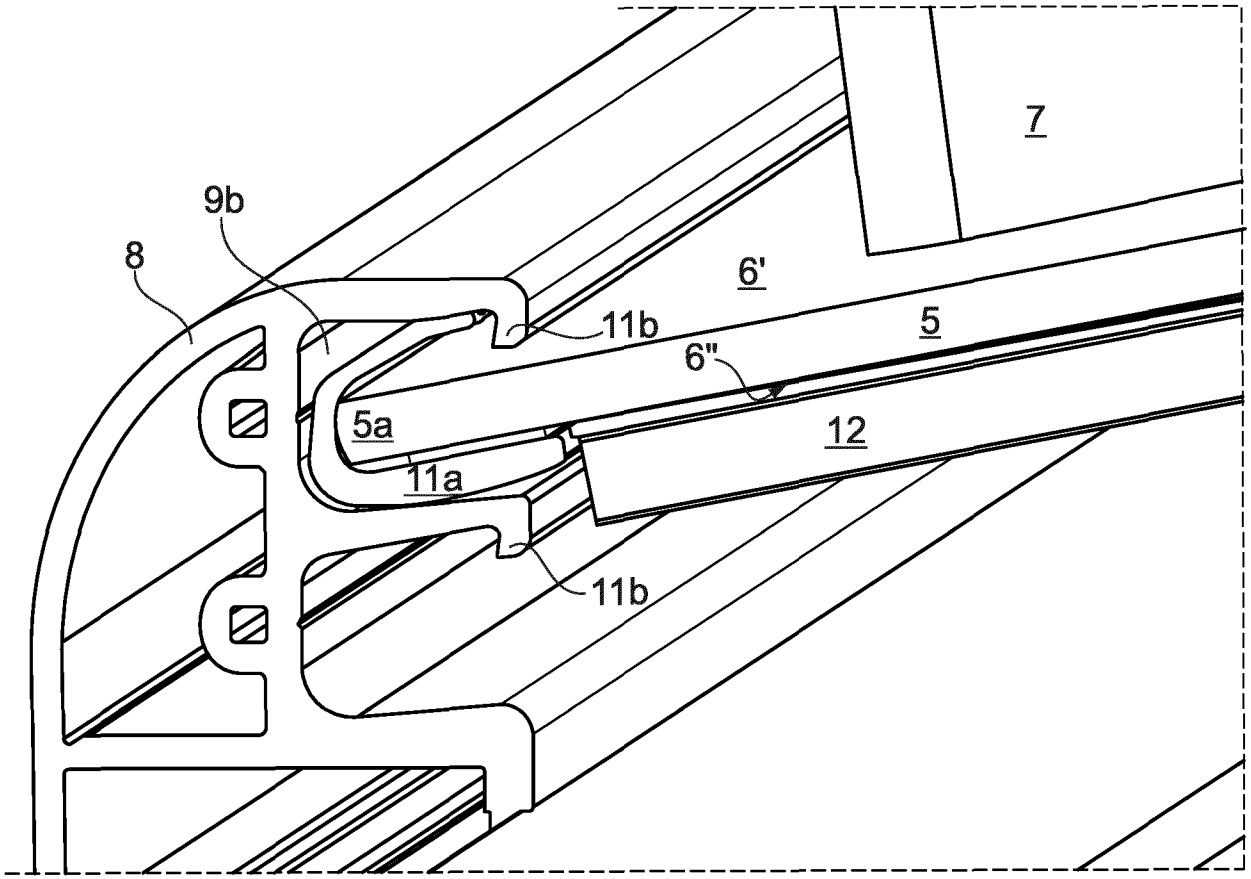

As can be seen in FIG. 2, the two adjacent tracks 9*a*, 9*b* for mounting a lid 5 are of different depths. One track 9*a* comprises a deep cavity and is referred to as a deep track 9*a* and the other comprises a shallow cavity and is referred to as a shallow track 9*b*. This arrangement of different depths of the tracks 9*a*, 9*b* makes it possible for the lid 5 to be mounted when the rails 8, 8*a* are mounted on the storage unit 1, the lids 5 may in particularly be mounted from above or below. The movements of the lid 5 in the method of mounting a lid 5 in the cover 4 is indicated in FIG. 2*a* by the marked arrows (X, Y and Z). The lid 5 is mounted by first inserting an edge 5*a* of the lid 5 in the deep track 9*a* and pushing it in direction X into the deep track 9*a* until the opposite edge 5*a* of the lid 5 may be inserted in the opposing shallow track 9*b* by lowering the lid 5 in direction Y and pushing the edge 5*a* of the lid 5 into the shallow track 9*b* in direction Z. The depth A of the deep track 9*a* is approximately 35 mm deep while the depth B of the shallow track 9*b* is approximately 12.5 mm. A seal 12 may be provided on the lower surface 6" of each lid 5 arranged in the top track 9 (see FIG. 2*b*). Each seal 12 may approximately extend between the adjacent tracks 9*a*, 9*b* in which the lid 5 is mounted and from the lower surface 6" of lid 5 towards an upper surface 6' of a neighbouring lid 5 mounted in the bottom tracks 9*a*, 9*b*. A more detailed view of the shallow 9*b* and deep tracks 9*a* can be found in FIGS. 3 and 4 respectively. These figures also show that the lid 5 being maintained in the adjacent tracks 9*a*, 9*b* by a retainer arrangement 11 which prevents a dislocation of the lids 5 from the tracks 9 and simultaneously allows the lids 5 to slide along the longitudinal extend of the tracks 9. In the present embodiment a retainer arrangement 11 is provided by both the deep track 9*a* and the shallow track 9*b* and essentially comprises a resilient latch 11*a* and a protrusion 11*b*. The latches 11*a* are fixed to edges 5*a* of the lid 5 arranged in the tracks 9*a*,9*b*, and are shaped such that a first part is parallelly abutting the lower surface 6" of the lid 5 and fixed hereto, preferably by using adhesive. From the lower surface 6" of the lid 5, the latch 11*a* extends around the edge 5*a* of the lid 5 and inwardly towards the middle of the upper surface 6' of the lid 5 and simultaneously upwardly in a direction away from the upper surface 6' of the lid 5, such that an angle of approximately 45 degrees is created between the upper surface 6' of the lid 5 and the latch 11*a*, measured at a position near the edge 5*a* of lid 5. The first part of the latch 11*a* at the lower surface 6" of the lid 5, provides a lower surface slidably abutting the lower side 10" of the track 9. The retainer arrangement 11 may be provided along each entire edge 5*a* of the lid 5 to be mounted in the track 9 or it may be provided at scattered positions along the edge 5*a* of the lid 5. In the present embodiment, the retainer arrangement 11 may be provided within a distance along each edge 5*a* of the lid 5 from each end of the edge 5*a* of the lid 5.

Figure 3:
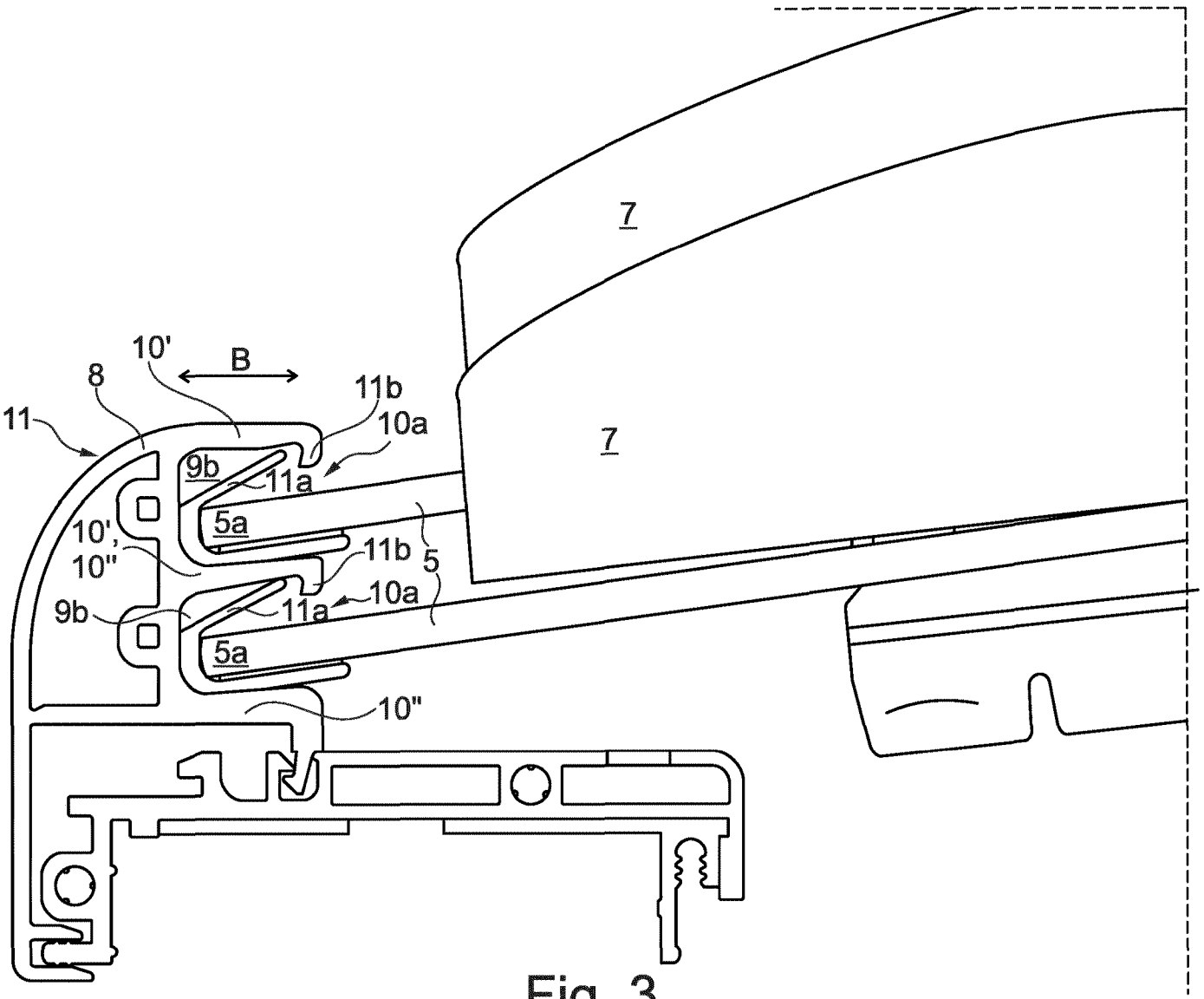
FIG. 3 is a detailed cross-sectional view of lids mounted in shallow tracks in a slide configuration, as shown in FIG. 1.
Figure 4:
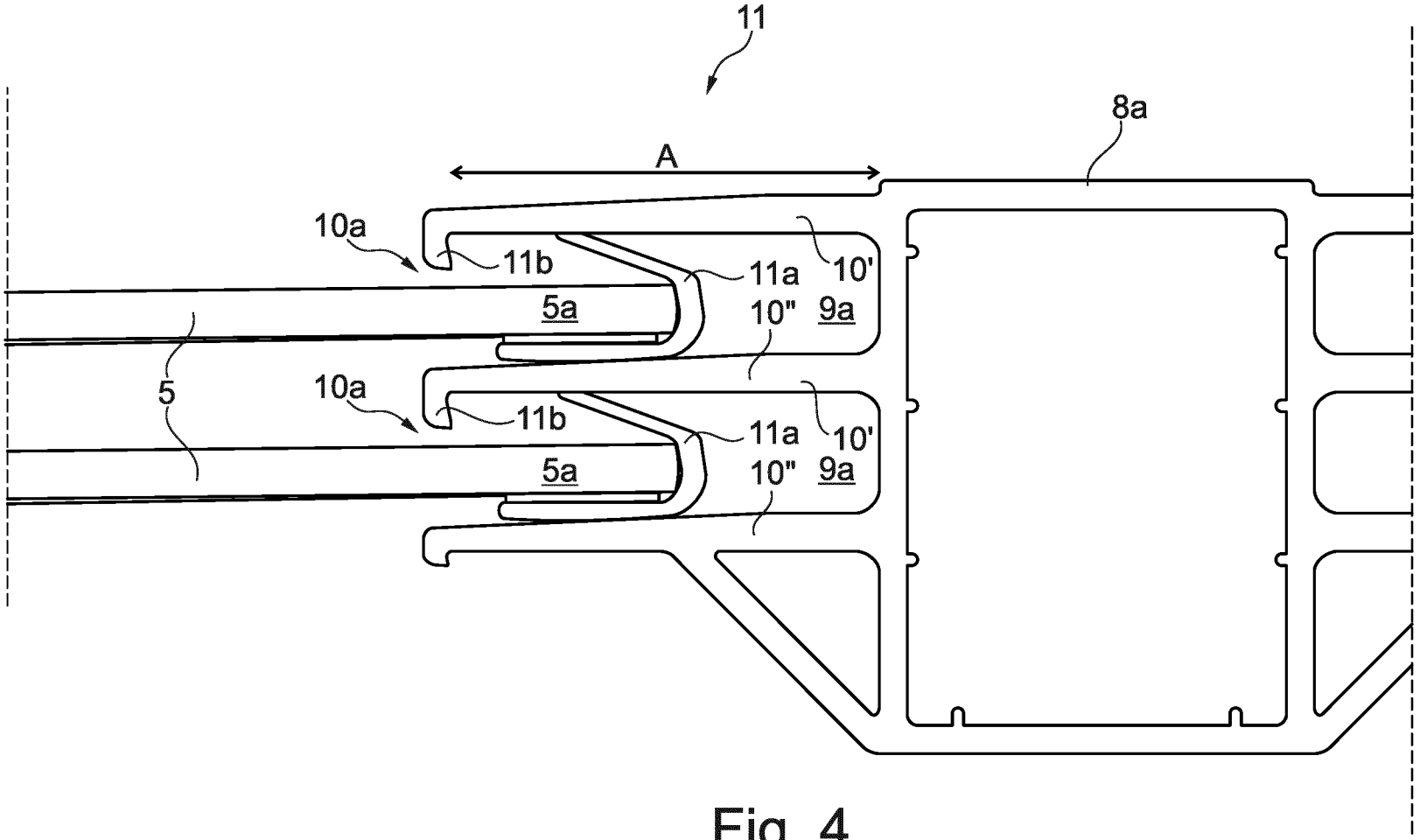
FIG. 4 is a detailed cross-sectional view of lids mounted in deep tracks in a slide configuration, as shown in FIG. 1.

The profile comprises a protrusion 11*b* located at the upper side of the track 9 and near the track opening 10*a*. The protrusion 11*b* protrudes inwardly and provides a smaller cross-sectional height of the track opening 10*a* relative to the cross-sectional height within the track 9. As seen in FIGS. 2, 3 and 4 when the lid 5 is mounted, the latch 11*a* extends upwardly to a position above the lower edge of the protrusion 11*b*. Any lateral forces applied to the lid 5 in a direction away from the track 9 will force the latch 11*a* to abut the protrusion 11*b* and possibly also the inside of the upper side 10' of the track 9, retaining the latch 11*a* within the track 9 and preventing any further lateral movement of the lid 5. Additionally, a recess may be provided in the inside surface of the upper side 10' of the track 9 for receiving a free end of the latch 11*a* and retaining the latch 11*a* in a specific position within the track 9.

As the cross-sectional height of the track opening 10*a* is smaller than the cross-sectional height within the track 9 due to the presence of the protrusion 11*b*, the lid 5 is mounted in the tracks 9 by forcing the resilient latch 11*a* to bend towards the upper surface 6' of the lid 5 such that the total cross-sectional area of the edge 5*a* of the lid 5 with the attached latch 11*a* is decreased to such an extent, that the latch 11*a* and the edge 5*a* of the lid 5 can fit through the track opening 10*a*. When the latch 11*a* has passed the track opening 10*a* and is positioned inside the track 9, the force on the latch 11*a* is lessened or released and the latch 11*a* assumes a position closer to its original position as can be seen on FIGS. 2, 3 and 4.

In alternative embodiments the protrusion 11*b* is resiliently arranged instead of the latch 11*a*, or the latch 11*a* as well as the protrusion 11*b* may be resiliently displaceable in order for allowing the edge 5*a* of the lid 5 to enter into the track 9.

In a further alternative embodiment, all or some of the adjacent rails 8, 8*a* for mounting of lids 5 may comprise deep tracks 9*a* only, wherein the lids 5 are retained therein using a retainer arrangement 11 provided near each deep track 9*a*.

Essentially the refrigerated storage unit 1 as shown in FIG. 5 comprises the same technical features as explained in relation to the refrigerated merchandising storage unit 1 as described in relation to FIGS. 1-4, with the difference that the lids 5 are mounted in a push configuration instead of a slide configuration. FIG. 5 shows a refrigerated merchandising storage unit 1 with a cover 4 comprising four lids 5 and three rails 8, 8*a* which are arranged such that the lids 5 can be displaced in a direction essentially parallel to the short sides 2*b* of the compartment 2 and perpendicular to the long sides 2*a* of the compartment 2. The lids 5 can be arranged in an open or closed position or in a position therein between and handles 7 are attached to the lids 5 allowing for easy displacement of the lids 5 along the rails 8, 8*a*. Two rails 8 are arranged at along the edges of the short sides 2*b* of the compartment 2, while the third rail 8*a* is arranged therein between in a substantially cantered position such that the top opening 3 is divided into two essentially equal sized openings. The four lids 5 are mounted in a symmetric configuration around the cantered rail 8*a*. On each side the two lids 5 are mounted in separate tracks 9, i.e. one is mounted in the top track 9 and the other lid 5 is mounted in the bottom track 9, such that they can be displaced independently. As for the configuration shown in FIGS. 1-4, the lids 5 in FIG. 5 are displaceably retained in the tracks 9 of the rails 8, 8*a* using retainer arrangement 11 and furthermore one track 9 is deeper than the adjacent track 9 such that the lids 5 may be mounted in rails 8, 8*a* that are already mounted on the storage unit 1, the lids 5 may in particular be mounted from above or below. Alternatively some or all of the lids 5 may be mounted in adjacent rails 8,8*a* comprising deep tracks 9*a* only, wherein the deep tracks are provided with retainer arrangements 11.

The lids 5 may be demounted from the rails 8, 8*a* by using a tool which can be used to force the latch 11*a* towards the surface 6' of the lid 5 and thereby allow for edge 5*a* of the lid 5 to be separated from the track 9. Demounting is accomplished by simultaneously forcing the latch 11*a* towards the surface 6' of the lid 5 and applying a lateral force to the lid 5 in a direction away from the track 9. The tool preferably comprises a thickness small enough to allow the tool to enter the track 9 between the side 10', 10" of the track and the lid 5. Furthermore the tool is preferably shaped such that it can access the upper side of the latch 11*a* and apply a force to the upper side of the latch 11*a* towards the lid 5. In one embodiment the tool may be of a shape similar to a credit card or the like.

LIST OF REFERENCE NUMERALS

1 Refrigerated merchandising storage unit
2 Storage compartment
2*a* Long side of the storage compartment
2*b* Short side of the storage compartment
3 Top opening
4 Cover
5 Lid
5*a* Edge of lid
6' Upper surface of lid
6" Lower surface of lid
7 Handles
8 Rail
8*a* Centred rail
9 Track
9*a* Deep track
9*b* Shallow track
10' upper side of the track
10" lower side of the track
10*a* Track opening
11 Retainer arrangement
11*a* Latch
11*b* Protrusion
12 Seal
A Depth of deep track
B Depth of shallow track
X Direction towards the deep track
Y Direction towards the bottom of the compartment
Z Direction towards the shallow track

The invention claimed is:

1. A refrigerated merchandising storage unit for display and sale of foodstuff comprising a storage compartment having a rectangular top opening, the storage unit further comprises a cover including a plurality of lids for being arranged displaceably for opening the storage unit so that access can be provided to the compartment, the cover is provided with a rail system with two or more mounted rails arranged between two opposite sides of the opening, each rail comprises a number of elongated and U-shaped tracks for receiving an edge of one of the plurality of lids, each of which lids includes a first surface and a second surface;

wherein each of the plurality of lids is arranged to be mounted between a first and a second of said mounted rails adjacent to one another, wherein the first rail comprises a first track and the second rail comprises a second track, wherein the rails are arranged such that a first lid of the plurality of lids can be mounted by displacing an edge of the first lid inside the first track until an opposite edge of the first lid can by swung into position substantially in a plane of the first lid and adjacent to the second track of the adjacent second rail, whereby said opposite edge of the first lid can be inserted inside the second track and the first lid thereby can be displaceably mounted between the two adjacent rails, and wherein the storage unit further comprises a retainer arrangement provided near a selected one of said first track or said second track and said lid for retaining the lid in that selected first track or second track, wherein the retainer arrangement comprises a latch fixed to the first lid and a protrusion fixed to that selected first track or second track, the latch and the protrusion being arranged such that when lateral extraction forces are applied to the first lid in a direction away from the track with the protrusion, the latch and the protrusion are forced into abutment producing a holding force so that a separation of the first lid and that selected first track or second track is prevented, wherein either the protrusion or the latch is made of a resilient flexible material such that the edge of the first lid can be inserted into that selected first track or second track, by bending either the latch towards the second surface of the first lid or the protrusion towards a side of the selected track on which the protrusion is fixed.

2. The refrigerated merchandising storage unit according to claim 1, wherein the latch as well as the protrusion are resiliently displaceable in order for allowing the edge of the first lid to enter into the selected first track or second track.

3. The refrigerated merchandising storage unit according to claim 1, wherein the first track is a deep track and the second track is a shallow track, wherein the deep track is deeper than the shallow track, and wherein said retainer arrangement is provided near said second, shallow track.

4. The refrigerated merchandising storage unit according to claim 3, wherein a second retainer arrangement is provided near said deep track, and wherein a protrusion of the second retainer arrangement is fixed to the deep track and a latch of the second retainer arrangement is fixed to the first lid, and wherein the protrusion and the latch of the second retainer arrangement are arranged to cooperate.

5. The refrigerated merchandising storage unit according to claim 1, wherein the protrusion extends generally perpendicular to and inwardly from the side of the selected track.

6. The refrigerated merchandising storage unit according to claim 1, wherein said latch is attached to the first surface of the first lid and extends around the edge of the first lid towards the second surface of the first lid where from the latch projects away from the first lid towards a position above the second surface of the first lid.

7. The refrigerated merchandising storage unit according to claim 1, wherein the number of elongated and U-shaped tracks of each rail is formed as a profile comprising a plurality of said tracks which are arranged above one another in a vertical row of tracks.

8. The refrigerated merchandising storage unit according to claim 7, wherein each lid is displaceably mounted in a separate track within the vertical row of tracks.

9. The refrigerated merchandising storage unit according to claim 7, wherein said vertical row of tracks in each said rail comprises either deep or shallow tracks only.

10. The refrigerated merchandising storage unit according to claim 9, wherein each lid of the plurality of lids is displacably mounted in separate tracks within the vertical row of tracks.

11. The refrigerated merchandising storage unit according to claim 1, wherein the two or more rails extend between two long sides of the compartment, from a first long side to a second long side and wherein the compartment is opened and closed by pushing the lids in a direction perpendicular to the long sides of the compartment, and parallel with short sides of the compartment.

12. The refrigerated merchandising storage unit according to claim 11, wherein the cover comprises three longitudinal rows of lids covering the top opening, of which one longitudinal row comprises a stationary cover plate which covers generally ⅓ of the width of the top opening and extends between the two short sides of the compartment.

13. The refrigerated merchandising storage unit according to claim 1, wherein the two or more rails extend between two short sides of the compartment, from a first short side to a second short side, and wherein the compartment is opened and closed by sliding the lids sideways in a direction parallel with long sides of the compartment.

14. The refrigerated merchandising storage unit according to claim 13, wherein the two or more rails near the long sides of the compartment comprise shallow tracks only.

15. The refrigerated merchandising storage unit according to claim 1, wherein the lids are transparent.

16. The refrigerated merchandising storage unit according to claim 1, wherein the cover is provided with a curved shape.

* * * * *